United States Patent [19]

Tacker

[11] Patent Number: 4,736,984

[45] Date of Patent: Apr. 12, 1988

[54] PIVOT ASSEMBLY FOR RECLINING CHAIR WITH ROCKING FEATURE

[75] Inventor: Bill D. Tacker, Okolona, Miss.

[73] Assignee: Super Sagless Corporation, Tupelo, Miss.

[21] Appl. No.: 925,310

[22] Filed: Oct. 31, 1986

[51] Int. Cl.[4] ..... A47C 3/02

[52] U.S. Cl. ..... 297/264; 248/575; 248/596

[58] Field of Search ..... 297/264, 261; 248/575, 248/596, 608, 372.1, 398

[56] References Cited

U.S. PATENT DOCUMENTS

| | | | |
|---|---|---|---|
| 75,246 | 3/1868 | Conant . | |
| 169,228 | 10/1875 | Best . | |
| 200,296 | 2/1878 | Hesse . | |
| 202,291 | 4/1878 | Spoerl et al. | 297/264 |
| 215,581 | 5/1879 | Dann . | |
| 224,340 | 2/1880 | Knochel | 207/264 |
| 252,031 | 10/1882 | Haman . | |
| 354,038 | 12/1886 | Bunker . | |
| 1,775,883 | 9/1930 | Bagnall . | |
| 1,854,442 | 4/1932 | Baird . | |
| 2,304,780 | 12/1942 | De Fries | 267/45 |
| 2,360,428 | 10/1944 | Larsen et al. | 248/596 |
| 2,729,273 | 1/1956 | Hamilton et al. | 248/596 X |
| 2,818,911 | 1/1958 | Syak | 248/596 X |
| 3,163,464 | 12/1964 | Martin et al. | 297/85 |
| 3,295,885 | 1/1967 | Barksdale | 297/264 X |
| 3,322,459 | 5/1967 | Hampton | 297/261 X |
| 3,603,553 | 9/1971 | Doerner | 248/596 X |
| 4,090,700 | 5/1978 | Davis | 267/45 |
| 4,214,726 | 7/1980 | Karrp et al. | 248/575 |

*Primary Examiner*—Philip C. Kannan
*Attorney, Agent, or Firm*—Wolf, Greenfield & Sacks

[57] ABSTRACT

A central pivot rocker spring assembly for connecting a base to a lower frame member in a reclining chair with a rocking feature so that the lower frame member pivots about a single axis of rotation. The spring assembly includes a first bracket mountable to the base, a second bracket mountable to the lower frame member and pivot pins securing the brackets together on the axis of rotation. A leaf spring biases the first and second brackets to selected relative positions. The leaf spring passes through and is fixed in position at its center on the axis of rotation. Thumbscrews coupling the leaf spring to the second bracket permit independent adjustment of the forward and backward rocking motions of the chair. The thumbscrews are movable to permit wide variations in biasing forces.

14 Claims, 4 Drawing Sheets

PIVOT ASSEMBLY FOR RECLINING CHAIR WITH ROCKING FEATURE

FIELD OF THE INVENTION

This invention relates to rocking chairs and, more particularly, to a spring-loaded pivot assembly for use in reclining chairs which rock in the upright position.

BACKGROUND OF THE INVENTION

Reclining chairs which rock in the upright position typically include a seat, arms, a back, and a curved rocker surface, which rocks on a base. Springs are used to restrain the movement of the rocker and to hold it in a fixed position when no one is sitting in it. A chair utilizing coil springs for restraining a rocker is disclosed in U.S. Pat. No. 3,163,464 issued Dec. 29, 1964 to Martin et al. The disadvantage of the disclosed chair is that the coil springs have no central pivot and allow unwanted movement of the rocker in relation to the base. Also, because of the non-rigid mounting of conventional springs, the use of a rocker blocking device is sometimes ineffective. The force on the rocker blocking device to contain the rocking motion of the chair is so great that it overcomes the force provided by the rocker springs and allows the base to shift in a forward or rearward direction. Furthermore, with conventional rockers several different extension-type coil spring gauges are needed to achieve desired forward and rearward rocking characteristics, thereby creating a problem with interchangeability and replacement. The conventional rocker box must be stretched with a tool to preload the spring and then applied to the base and frame. In addition, the exact center of gravity must be determined and the springs attached in close proximity to that point. These factors make assembly of the chair somewhat difficult.

Leaf springs for controlling the motion of a rocking chair are disclosed in U.S. Pat. Nos. 75,246 issued Mar. 10, 1868 to Conant and 200,296 issued Feb. 12, 1878 to Hesse. These patents disclose rocking chairs wherein rocking motion is provided by a curved portion of the rocker rolling on the base. A leaf spring attached at its center to the base and at its ends to the rocker controls rocking movement. U.S. Pat. No. 169,228 issued Oct. 26, 1875 to Best contains a similar disclosure except that the center of the leaf spring is attached to a pivoting shaft. U.S. Pat. No. 252,031 issued Jan. 10, 1882 to Haman discloses a rocking chair with a leaf spring which is adjustable in position. U.S. Pat. No. 215,581 issued May 20, 1879 to Dann discloses a rocking chair having L-shaped wire springs for controlling motion.

It is a general object of the present invention to provide improved rocking chairs and reclining chairs with a rocking feature.

It is another object of the present invention to provide rocking chairs wherein a movable lower frame member pivots about a single axis of rotation relative to the base.

It is a further object of the present invention to provide rocking chairs with a rocker spring assembly which does not permit lateral, forward or rearward movement of a movable lower frame member in relation to the base.

It is a further object of the present invention to provide rocking chairs with a rocker spring assembly which is adjustable.

SUMMARY OF THE INVENTION

According to the present invention, these and other objects and advantages are achieved in a chair comprising a base, a lower frame member movable relative to the base, pivot means for connecting the lower frame member to the base so that the lower frame member pivots about a single axis of rotation relative to the base, and spring means for biasing the lower frame member toward a selected position about the axis of rotation. It is preferred that the pivot means comprise at least one bracket assembly including a first bracket mounted to the base and including at least a first hole aligned with the axis of rotation, a second bracket mounted to the lower frame member and including at least a second hole aligned with the axis of rotation, and at least a first pivot pin secured through the first hole and the second hole. The lower frame member pivots about the pivot pin and is controlled in its position by the spring means.

According to one aspect of the invention, the spring means comprises a leaf spring coupled at spaced-apart locations to one of the brackets and coupled between the spaced apart locations to the other of the brackets. In a preferred embodiment, the leaf spring is fixed in position near or on its center and on the axis of rotation.

According to another aspect of the invention, the chair further includes adjustment means for adjusting the force with which the leaf spring biases the lower frame member toward the selected position. The adjustment means preferably comprises adjustable couplings between the spaced-apart locations and the second bracket, each adjustable coupling comprising a manually-adjustable, threaded stud which permits adjustment of the distance between the second bracket and the point of contact with the leaf spring. In another feature of the invention, the adjustable springs are movable along the length of the leaf spring to compensate for variations in the center of gravity and to independently adjust the forward and backward biasing forces provided by the leaf spring.

According to still another aspect of the invention, there is provided a central pivot rocker spring assembly for connecting a chair base to a lower frame member of a chair. The assembly includes a pivot assembly for connecting the lower frame member to the chair base so that the lower frame member pivots about a single axis of rotation relative to the chair base. The pivot assembly comprises a first bracket mountable to the lower frame member and including at least one hole aligned with the axis of rotation, a second bracket mountable to the lower frame member and including at least a second hole aligned with the axis of rotation, and at least a first pivot pin secured through the first hole and the second hole. The rocker spring assembly further includes spring means for biasing the first and second brackets to selected relative positions.

BRIEF DESCRIPTION OF THE DRAWINGS

For a better understanding of the present invention, together with other and further objects, advantages, and capabilities thereof, reference is made to the accompanying drawings which are incorporated herein by reference and in which.

DETAILED DESCRIPTION OF THE INVENTION

Figure 1:
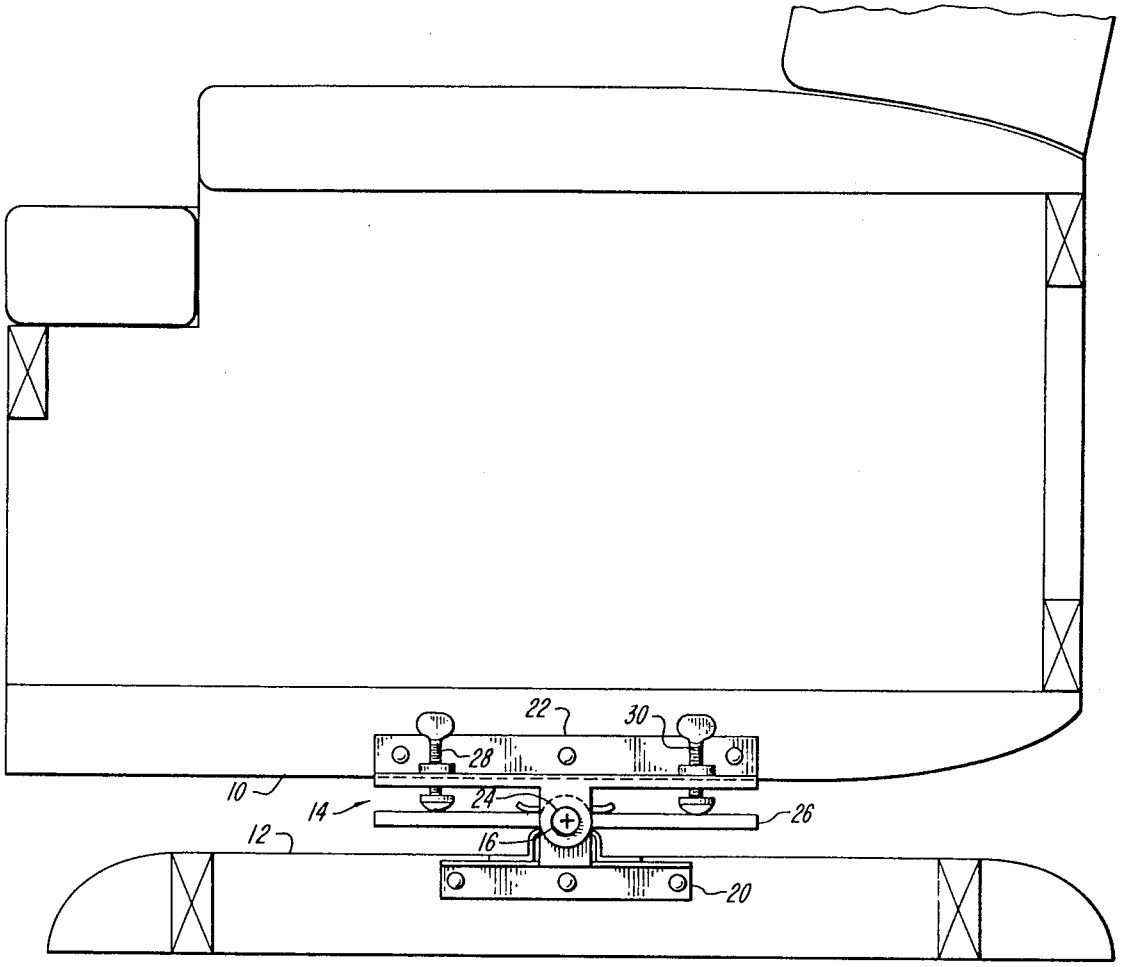
FIG. 1 is a cross-sectional view of a rocking chair in accordance with the present invention.

A cross-sectional view of a chair in accordance with the present invention is shown in FIG. 1. The chair can be a reclining chair which rocks in the upright position or can be a conventional rocking chair. A lower frame member 10 supporting a seat, a back and arms is connected to a chair base 12 by two pivoting rocker spring assemblies 14, only one of which is shown. The other assembly is the mirror image of the assembly 14 shown, and they are arranged on opposite sides of the chair. The rocker spring assemblies 14 have aligned axes of rotation 16 so that the lower frame member 10 pivots about a single axis of rotation 16. Each rocker spring assembly 14 includes a first bracket 20 rigidly attached to the base 12, a second bracket 22 rigidly attached to the lower frame member 10, and one or more pivot pins 24 which connect the first and second brackets 20, 22 on the axis of rotation 16. Each spring assembly 14 further includes a leaf spring 26 which passes through the axis of rotation 16 and is attached, typically at its center, to the first bracket 20. Leaf spring 26 is adjustably connected by means of screws 28 and 30 to second bracket 22.

Figure 2:
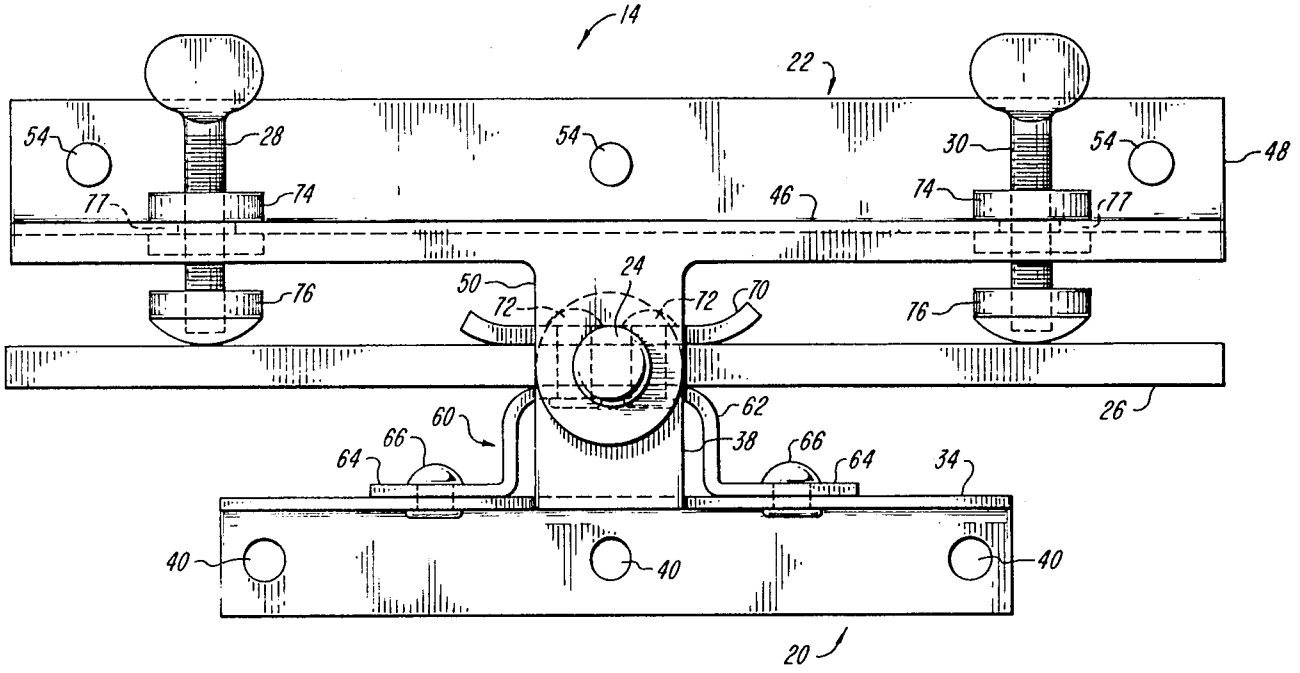
FIG. 2 is an elevation of a rocker spring assembly in accordance with the present invention.
Figure 3:
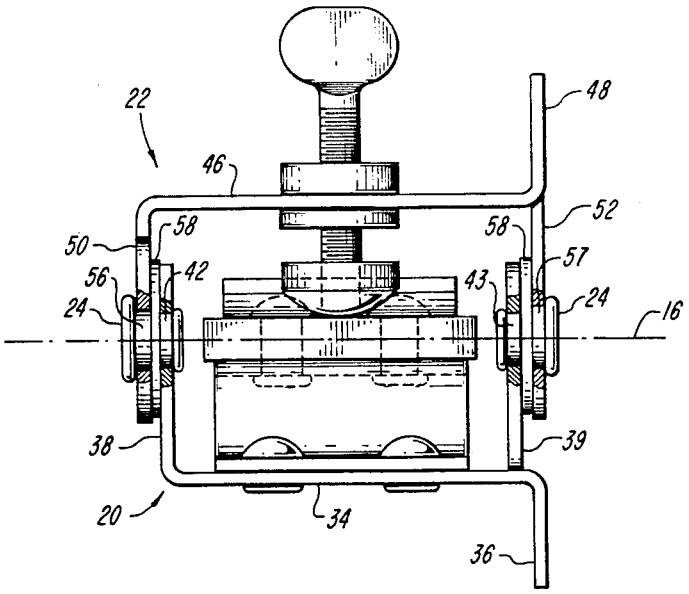
FIG. 3 is an end view of a rocker spring assembly in accordance with the present invention.

The rocker spring assembly 14 is shown in more detail in FIGS. 2 and 3. The first bracket 20 includes a generally flat, central portion 34 with a downwardly extending flange 36 along one side edge and upwardly extending flanges 38 and 39 along opposite side edges of the central portion 34. The downwardly extending flange 36 includes mounting holes 40 through which screws, bolts or other mounting hardware secure the bracket 20 to the base 12. The upwardly extending flanges 38, 39 on opposite sides of the central portion 34 define holes 42, 43, respectively, which are aligned with and establish the axis of rotation 16.

The second bracket 22 includes a generally flat, central portion 46 with an upwardly extending flange 48 along one edge and downwardly extending flanges 50 and 52 along opposite side edges. The upwardly extending flange 48 includes mounting holes 54 through which are secured bolts or screws for mounting the second bracket 22 to the lower frame member 10. The downwardly extending flanges 50 and 52 define holes 56 and 57, respectively, each aligned with the axis of rotation 16. The first bracket 20 and the second bracket 22 are typically fabricated from sheet metal.

The flanges 38, 39 of bracket 20 and the flanges 50, 52 of bracket 22 have relative spacings which permit the flanges 50 and 38 to be connected together by a pivot pin 24, and flanges 39 and 52 to be connected together by a pivot pin 24, as best seen in FIG. 3. Optional washers 58 can be placed between flanges 50 and 38 and between flanges 39 and 52 to prevent binding during rocking motion. It can be seen that the pivot pins 24 permit pivoting of the first bracket 20 relative to the second bracket 22 about pivot pins 24 on axis of rotation 16. In a preferred embodiment, the pivot pins 24 are rivets.

The leaf spring 26 is mounted by means of a spring bracket 60 attached to the first bracket 20. The spring bracket 60 can be a sheet metal strip having a generally U-shaped portion 62 and outwardly directed parallel flanges 64. The spring bracket 60 is secured to the first bracket 20 with rivets 66 or other mounting hardware through holes in flanges 64 and through the central portion 34 of bracket 20. A retainer 70 is located above the leaf spring 26 with curved ends to permit uninhibited flexing of the leaf spring 26. Rivets 72 or bolts pass through aligned holes in retainer 70, leaf spring 26 and the base of U-shaped portion 62 of spring bracket 60 to secure the center of the leaf spring 26 in a fixed position on the axis of rotation 16. The leaf spring 26 can be fabricated of steel or plastic.

The adjustment screws 28 and 30 are spaced at locations on opposite sides of the axis of rotation 16. Each of the screws, 28, 30 is threaded through a bushing 74 and has a convex knob 76 attached to the end thereof which contacts the leaf spring 26. Each of the screws 28, 30 preferably has a flattened head to facilitate manual adjustment of the load imposed by each screw. Each of the bushings 74 is generally cylindrical in shape with a threaded central hole therethrough for the adjustment screw and includes a circumferential groove 77 on its outer surface adapted to slide into a slotted hole in the central portion 46 of bracket 22. When either of the adjustment screws 28 or 30 is turned, the biasing force between the leaf spring 26 and the bracket 22 through the knob 76 and the adjustment screw is increased or decreased. The two screws can be adjusted independently to vary the forward and backward biasing forces independently. Furthermore, the adjustment screws can be utilized to overcome differences in the spring constant, the weight of the user and other variations.

Figure 4:
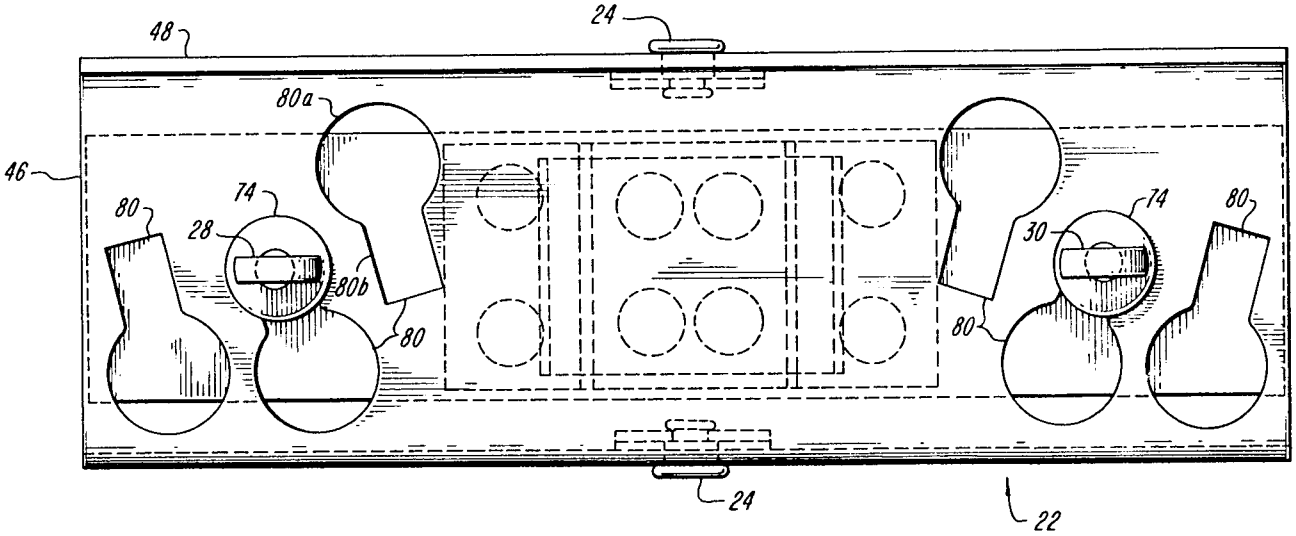
FIG. 4 is a top view of a rocker spring assembly in accordance with the present invention.

In a further feature of the rocker spring assembly of the present invention, the adjustment screws 28 and 30 are movable along the length of the leaf spring 26. This can be accomplished by providing a slot in the second bracket 22 or by providing a plurality of individual keyhole shaped holes 80 (FIG. 4) spaced along the length of second bracket 22 for installation of the bushings 74. Each of the bushings 74 is inserted through enlarged portion **80*a* of a selected one of the holes 80 and then is slid into the smaller portion 80*b* where the annular groove 77 engages the sides of the hole and is retained in position. The ability to move the adjustment screws 28, 30 permits compensation for incorrect mounting of the spring assembly relative to the center of gravity of the rocker and permits wide variation in the biasing forces applied to the leaf spring 26**.

The rocker spring assembly shown and described hereinabove, provides a number of important advantages. The pivoting of the lower frame member about a single axis of rotation 16 does not permit lateral, forward or rearward movement in relation to the base. The leaf spring 26 can be preloaded by the adjustment screws 28 and 30 during assembly of the chair. The pivoting of the lower frame member 10 about the axis of rotation 16 contains the forces generated by engagement of the rocker blocking device. Instead of using springs of several different strengths to achieve the correct rocking characteristics of a particular style chair, the assembly of the present invention incorporates movable adjustment screws, which reduces the spring types that must be stocked by the factory and by the customer. Furthermore, the customer can change spring characteristics easily without having to order special springs. Finally, the movable adjustment screws compensate for incorrect center of gravity mounting and permit a custom forward and rearward rocking motion.

While there has been shown and described what is at present considered the preferred embodiment of the present invention, it will be understood by those skilled in the art that various changes and modifications may be made therein without departing from the scope of the invention as defined by the appended claims.

What is claimed is:

1. A chair comprising:

a base;

a lower frame member supporting a seat and movable relative to said base;

pivot means for connecting said lower frame member to said base so that said lower frame member pivots about a single axis of rotation relative to said base, said pivot means comprising at least one bracket assembly including a first bracket mounted to said base and defining at least a first hole aligned with said axis of rotation;

a second bracket mounted to said lower frame member and defining at least a second hole aligned with said axis of rotation; and at least a first pivot pin secured through said first hole and said second hole so that said lower frame member pivots about said pivot pin; and spring means for biasing said lower frame member toward a selected position about said axis of rotation, said spring means comprising a leaf spring coupled at spaced-apart locations to one of said brackets and coupled between said spaced-apart locations to the other of said brackets.

2. A chair as defined in claim 1 wherein said leaf spring is fixed in position near or on its center and on said axis of rotation.

3. A chair as defined in claim 1 further including adjustment means for adjusting the force with which said spring means biases said lower frame member toward the selected position.

4. A chair as defined in claim 2 wherein said first bracket further defines a third hole spaced from said first hole and aligned with said axis of rotation, said second bracket further defines a fourth hole spaced from said second hole and aligned with said axis of rotation, and further including a second pivot pin secured through said third hole and said fourth hole.

5. A chair as defined in claim 4 wherein said first and second pivot pins comprise rivets.

6. A chair as defined in claim 4 wherein said leaf spring is coupled at spaced-apart locations to said second bracket and is coupled near or on its center and on said axis of rotation to said first bracket.

7. A chair as defined in claim 6 further including adjustment means for adjusting the force with which said leaf spring biases said lower frame member toward the selected position.

8. A chair as defined in claim 7 wherein said adjustment means comprises adjustable couplings between said spaced-apart locations and said second bracket.

9. A chair as defined in claim 8 wherein said adjustable couplings each comprise a manually-adjustable, threaded stud which permits adjustment of the distance between said second bracket and the point of contact with said leaf spring.

10. A chair as defined in claim 8 wherein said adjustable couplings are movable along the length of said leaf spring.

11. A chair as defined in claim 8 wherein two adjustable couplings are located on opposite sides of said axis of rotation so as to provide independent adjustment of the forward and backward biasing forces by said leaf spring on said lower frame member.

12. A central pivot rocker spring assembly for connecting a chair base to a lower frame member of a chair comprising:

a pivot assembly for connecting the lower frame member to the chair base so that the lower frame member pivots about a single axis of rotation relative to the chair base, said pivot assembly comprising a first bracket mountable to the chair base and defining at least one hole aligned with said axis of rotation, a second bracket mountable to the lower frame member and defining at least a second hole aligned with said axis of rotation, and at least a first pivot pin secured through said first hole and said second hole; and spring means for biasing said first and said second brackets to selected relative positions, said spring means comprising a leaf spring coupled at spaced-apart locations to one of said brackets and coupled near or on its center and on said axis of rotation to the other of said brackets.

13. A rocker spring assembly as defined in claim 12 further including adjustment means for adjusting the force with which said leaf spring biases said brackets toward said selected position.

14. A rocker spring assembly as defined in claim 12 including first bracket portions on opposite sides of said leaf spring defining said first hole and a third hole aligned with said axis of rotation, second bracket portions on opposite sides of said leaf spring defining said second hole and a fourth hole aligned with said axis of rotation, and a second pivot pin secured through said third and fourth holes.

* * * * *